US006520096B2

(12) United States Patent
Takemasa

(10) Patent No.: US 6,520,096 B2
(45) Date of Patent: Feb. 18, 2003

(54) DISPOSAL APPARATUS OF COMBUSTIBLE FLUORINE-SERIES REFRIGERANT COMPOSITION

(75) Inventor: Kazuo Takemasa, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/275,139

(22) Filed: Mar. 23, 1999

(65) Prior Publication Data

US 2002/0042553 A1 Apr. 11, 2002

(30) Foreign Application Priority Data

Mar. 25, 1998 (JP) ..... 10-077821

(51) Int. Cl.[7] ..... F23G 5/00; A62D 3/00

(52) U.S. Cl. ..... 110/235; 423/240 R; 431/2; 431/3; 431/5; 588/206; 588/207; 588/213; 588/248

(58) Field of Search ..... 588/205, 206, 588/207, 208, 209, 248, 213; 423/240 R; 110/235; 431/2, 3, 5

(56) References Cited

U.S. PATENT DOCUMENTS

| | | | | |
|---|---|---|---|---|
| 3,984,206 A | * | 10/1976 | Winnen | 23/262 |
| 4,125,593 A | * | 11/1978 | Scheifley et al. | 423/481 |
| 5,151,263 A | * | 9/1992 | Okazaki et al. | 423/659 |
| 5,705,140 A | * | 1/1998 | Johansing, Jr. | 423/490 |
| 5,977,427 A | * | 11/1999 | Tamata et al. | 588/206 |
| 6,023,007 A | * | 2/2000 | Nakajo et al. | 588/205 |
| 6,235,215 B1 | * | 5/2001 | Seino et al. | 252/68 |
| 6,274,062 B1 | * | 8/2001 | Tieken | 252/67 |

* cited by examiner

*Primary Examiner*—Stanley S. Silverman
*Assistant Examiner*—Maribel Medina
(74) *Attorney, Agent, or Firm*—Hogan & Hartson, LLP

(57) ABSTRACT

A disposal apparatus comprise a combustion furnace and a refrigerant feed unit for drawing out a combustible fluorine-series refrigerant composition containing a fluorine-series refrigerant and $C_1$–$C_5$ hydrocarbons from a refrigeration apparatus when the refrigeration apparatus packed therewith is to be disposed, wherein the disposal apparatus combusts and decomposes the refrigerant composition so as to avoid the atmospheric discharge of the not-yet-decomposed fluorine-series refrigerant gas together with the discharge of discharge gas.

5 Claims, 4 Drawing Sheets

DISPOSAL APPARATUS OF COMBUSTIBLE FLUORINE-SERIES REFRIGERANT COMPOSITION

BACKGROUND OF THE INVENTION

1. Field of the Invention

The present invention relates to a disposal apparatus of combustible fluorine-series refrigerant composition and a disposal method thereof.

2. Description of the Related Art

Conventional refrigerants for refrigeration apparatus such as a freezer mainly comprise dichlorodifluoromethane (R-12) and an azeotropic refrigerant R-500 composed of R-12 and 1,1-difluoroethane (R-152a). When the refrigerants are individually discharged into air to reach the ozone layer in the global sky, the refrigerants destroy the ozone layer with the high ozone-destroying potency thereof The destruction of the ozone layer is triggered by chloride (CL) groups in the refrigerants. Therefore, alternatives to these refrigerants have been proposed, including those with a reduced content of chloride groups, for example chlorodifluoromethane (HCFC-22); refrigerants with no content of chloride groups, for example difluoromethane (HFC-32, R-32), trifluoromethane (PFC-23, R-23), pentafluoroethane (HFC-125, R-125), 1,1,1,2-tetrafluoroethane (HFC-134a, R-134a), and 1,1,1-trifluoroethane (HFC-143a, R-143a); fluorocarbon-series. refrigerants without any content of chloride group and hydrogen (FC-series refrigerants); or mixtures thereof.

These fluorine-series refrigerants have been known to have a risk of the destruction of the ozone layer and a global warming effect, and the risk and the effect both are larger by about 1000-fold those of carbon dioxide. Currently, therefore, a proposition is made about the recovery and subsequent decomposition of these fluorine-series refrigerant gases from freezers and refrigerators to be intentionally disposed because of no use, by combustion or recycling after refinement.

However, the recovery, refinement and decomposition of these fluorine-series refrigerant gases are Laborious and highly costly, disadvantageously.

So as to overcome the problems, the inventors have previously proposed a refrigeration apparatus charged with a combustible refrigerant composition containing an HFC-series refrigerant or an FC-series refrigerant and a hydrocarbon, and a disposal apparatus for combusting such combustible refrigerant composition in atmosphere and a disposal method thereof. Disadvantageously, however, these fluorine-series refrigerant gases are not readily decomposed. Therefore, the fluorine-series refrigerant gases incompletely decomposed are discharged together with discharge gas into air.

SUMMARY OF THE INVENTION

The present invention can overcome the problems. It is an object of the invention to provide a disposal apparatus of combustible fluorine-series refrigerant composition and a disposal method thereof, wherein hardly decomposable fluorine-series refrigerant gases are readily combusted and decomposed to avoid atmospheric discharge of non-decomposed fluorine-series refrigerant gases together with discharge gas.

A first aspect of the invention relates to a disposal apparatus of combustible fluorine-series refrigerant composition, for use in drawing out and disposing a combustible fluorine-series refrigerant composition containing a fluorine-series refrigerant and hydrocarbons having 1 to 5 carbon atoms from a refrigeration apparatus packed therewith, the disposal apparatus comprising a combustion furnace, a refrigerant feed unit for drawing out a combustible fluorine-series refrigerant composition from the refrigeration cycle of the refrigeration apparatus and feeding the composition to the combustion furnace, an air feed unit for feeding fresh air for combustion So the combustion furnace, and a water vapor feed unit for feeding water vapor to thee combustion furnace, wherein the combustible fluorine-series refrigerant composition is combusted and decomposed in the presence of water vapor in the combustion furnace to be then disposed.

A second aspect of the invention relates to a disposable apparatus according to the first aspect of the invention, additionally comprising a disposal unit of discharge gas generated during the combustion and decomposition of the combustible fluorine-series refrigerant composition in the presence of water vapor.

A third aspect of the invention relates to a disposal apparatus according to the first aspect of the invention, wherein the. Refrigerate feed unit comprises a pressure regulator and a combustion means connected to the pressure regulator.

A fourth aspect of the invention relates to a disposal apparatus according to the first aspect of the invention, wherein hydrocarbons having 1 to 5 carbon atoms are contained at about 6% by weight or more to about 90% by weight or less on the basis of the whole composition.

A fifth aspect of the invention relates to a disposal apparatus according to the first aspect of the invention, wherein the disposal apparatus is of a portable type.

A sixth aspect of the invention relates to a disposal apparatus according to the first aspect of the invention, the mixtures of combustible fluorine-series refrigerant composition with fresh air are continuously combustible in an atmosphere at a temperature of 800° C. or higher.

A seventh aspect of the invention relates to a disposable method of combustible fluorine-series refrigerant composition, comprising combusting and decomposing a combustible fluorine-series refrigerant composition containing a fluorine-series refrigerant and hydrocarbons having 1 to 5 carbon atoms in the presence of water vapor at an inner furnace temperature of 800° C. or more.

An eighth aspect of the invention relates to a disposal method according to the seventh aspect of the invention, the combustible fluorine-series refrigerant composition comprising a combination of an inflammable HFC refrigerant and hydrocarbons having 1 to 5 carbon atoms, or a combination of an inflammable HFC refrigerant, a combustible HFC refrigerant and hydrocarbons having 1 to 5 carbon atoms.

DETAILED DESCRIPTION OF THE INVENTION

Figure 1:
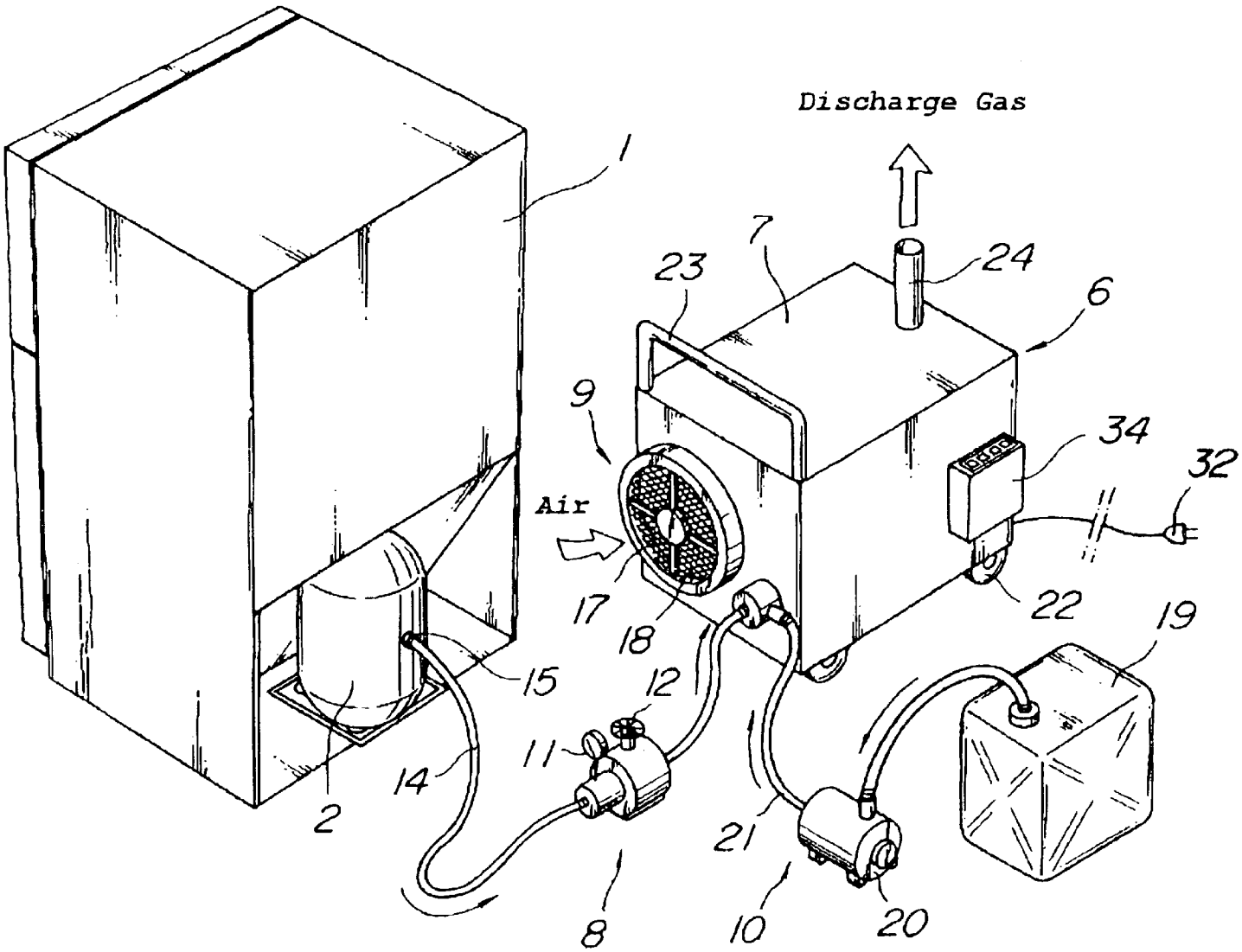
FIG. 1 is an explanatory view of a disposal apparatus as one example of the invention in connection to a refrigerator.

For example, dichlorodifluoromethane (R-12) is hardly decomposed even under heating, as shown below by the formula 1.

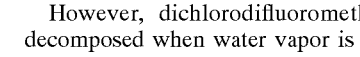

$$CCl_2F_2 \rightarrow C + Cl_2 + F_2 \quad (1)$$

$\Delta G^0$ (free enthalpy):909 kJ/mol $\Delta H^0$ (enthalpy):1193 kJ/mol

However, dichlorodifluoromethane (R-12) is readily decomposed when water vapor is added thereto, as shown below by the formula 2.

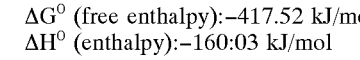

$$CCl_2F_2 + H_2O \rightarrow CO_2 + 2HCl + 2HF \quad (2)$$

$\Delta G^0$ (free enthalpy):−417.52 kJ/mol $\Delta H^0$ (enthalpy):−160:03 kJ/mol In accordance with the invention, combustible fluorine-series refrigerant compositions are combusted and decomposed in the presence of water vapor in a combustion furnace. Because combustible fluorine-series refrigerant compositions can be combusted and decomposed smoothly in the presence of water vapor at an inner furnace temperature of preferably 800° C. or higher, non-decomposed fluorine-series refrigerant compositions are never discharged together with discharge gas into atmosphere.

In accordance with the invention, combustible fluorine-series refrigerant compositions are used, including for example CFC-series refrigerants [for example, dichlorodifluoromethane (R-12)], HCFC-series refrigerants [for example, chlorodifluoromethane (HCFC-22), etc.], HFC-series refrigerants (for example, R134a, R125, R143a, R32, R23, R14, etc.), FC-series refrigerants, or mixtures of these refrigerants with addition of hydrocarbons having 1 to 5 carbon atoms ($C_1$–$C_5$) . These combustible fluorine-series refrigerant compositions are produced in such a manner that once the compositions are combusted, heat continuously generated from the oxidation successively progresses the combustion to decompose the molecular structures of the fluorine-series refrigerants. After combustion, discharge gas never contains any fluorine-series refrigerant destroying the ozone layer or having a large warming coefficient, but contains $CO_2$, $H_2O$, HCl, HF, and the like with small warming coefficients.

Specific examples of the combustible fluorine-series refrigerant compositions for use in accordance with the invention irclude for example R-134a/R-600 (n-butane), R-134a/R-600/R-290 (propane), R-143a/R-134a/R-600a (isobutane), and R-32/R-125/R-134a/R-290.

Specific preferable examples of the combustible fluorine-series refrigerant compositions include combinations of a flammable HFC refrigerant and a $C_1$–$C_5$ hydrocarbon, for example R-134a/R-600 (n-butane) and R-134a/R-600/R-290 (propane), combinations of a flammable HFC refrigerant, a combustible HFC refrigerant and a $C_1$–$C_5$ hydrocarbon, for example R143a/R134a/R-600a (isobutane) and R-32/R-125/R-134a/R-290. The mixtures of these gases with fresh air are never continuously combustible in an atmosphere at ambient temperature, but are continuously combustible in an atmosphere at a temperature of 800° C. or higher.

The inventive disposal apparatus equipped with discharge gas disposal unit for absorbing and removing acidic substances such as HCl and HF contained in discharge gas can prevent atmospheric discharge of these acidic substances concurrently with the discharge of discharge gas, when the discharge gas disposal unit absorbs and removes acidic substances such as HCl and HF.

Any $C_1$–$C_5$ hydrocarbon of a linear or branched molecular structure or a mixture thereof may be used in accordance with the invention, including for example methane, ethane, propane, butane, pentane, isobutane, and isopentane.

The mixing ratio of the hydrocarbon for promoting the combustion as described above is larger than about 6% by weight; at a ratio less than about 6% by weight, the resulting composition is never combustible; at a hydrocarbon ratio above above 90%, almost not any advantage can be procured from the hydrocarbon mixed into HFC-series refrigerants or FC-series refrigerants. When the hydrocarbon is used within a range of the ratio of the mixed $C_1$–$C_5$ hydrocarbon being above 6% by weight or more to above 90% by weight, mineral oils and synthetic oils such as alkylbenzene and HAB can be used as a refrigeration oil; and additionally, the resulting mixture has high COP and can be most safely combusted; during the combustion, furthermore, heat capacity decomposing the molecular structures of the fluorine-series refrigerants can be yielded.

The combustible fluorine-series refrigerant composition for use in accordance with the invention should be adjusted to a positive pressure as low as about 1 to 10 kPa (compared with atmospheric pressure) and then combusted and decomposed stably and safely.

The combustible fluorine-series refrigerant composition can be combusted and decomposed stably and safely, by arranging a pressure regulator capable of adjusting the pressure of the refrigerant composition to an extremely low pressure on the tip of an outward open-type valve in a sealing pipe for sealing the combustible fluorine-series refrigerant composition in a compressor in a refrigeration cycle or on the tip thereof in a refrigeration cycle, mixing an appropriate volume of water vapor with the combustible fluorine-series refrigerant composition supplied from a combustion nozzle connected with the pressure regulator and then firing the composition.

The inventive disposal apparatus when equipped with wheels or a handle can be modified as portable. Then, the resulting apparatus can be easily moved and transferred to a site on demand; for disposal, the apparatus can be operated for example on a site where a to-be-disposed refrigeration apparatus is located. Hence, the delivery cost is then small.

The pressure regulator is arranged so that the combustible fluorine-series refrigerant composition continuously discharged from the refrigeration cycle is retained at such a pressure that the composition can be continuously combusted. The pressure regulator has a function to automatically adjust the secondary pressure to about 1 to 10 kPa, ideally to about 3 kPa, even if the primary pressure of the combustible fluorine-series refrigerant composition markedly changes in the refrigeration cycle.

DESCRIPTION OF THE PREFERRED EMBODIMENTS

Figure 2:
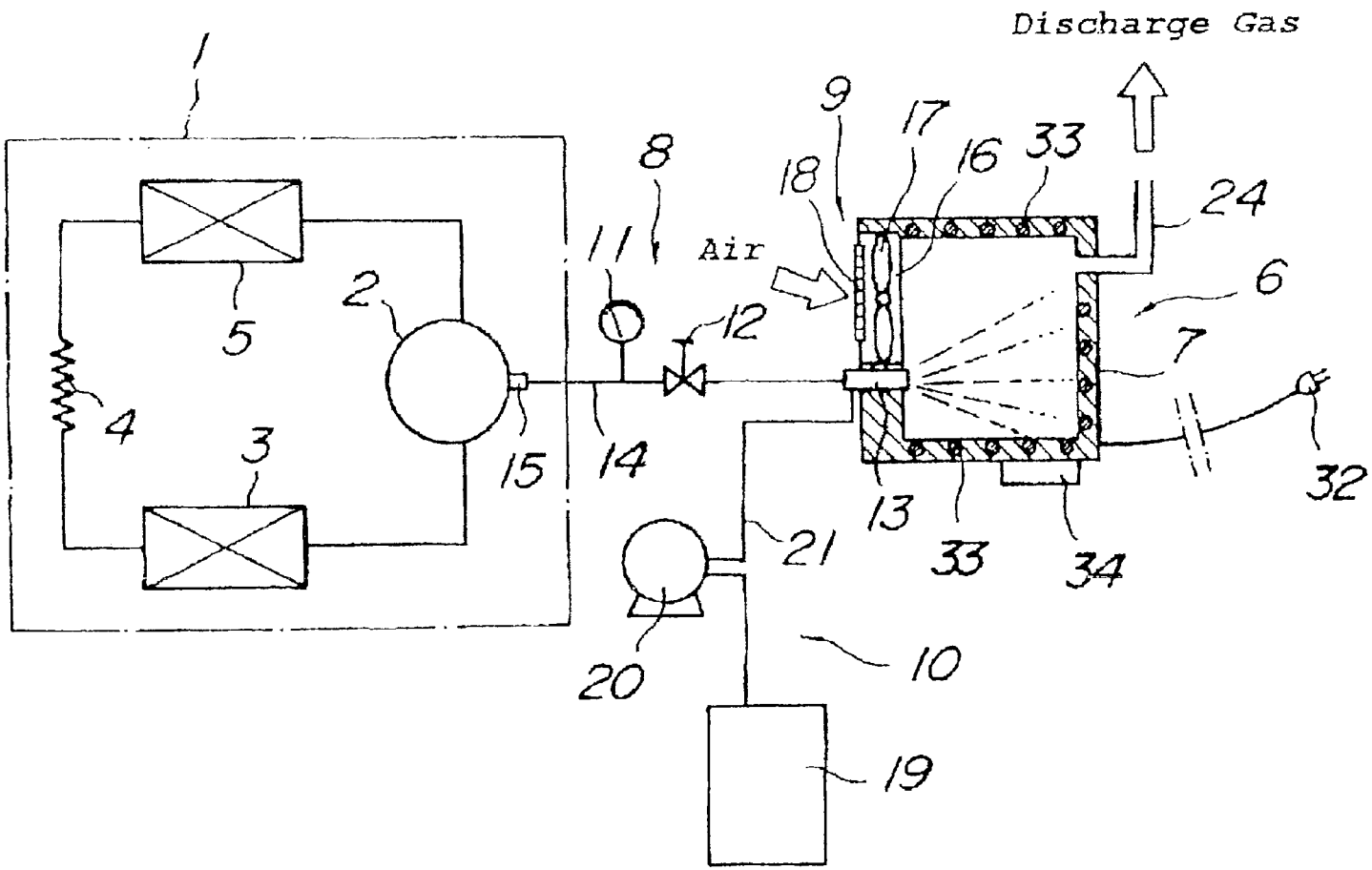
FIG. 2 is an explanatory view of the inventive disposal apparatus in connection to the refrigeration cycle of the refrigerator shown in FIG. 1.

FIG. 1 is an explanatory view of a disposal apparatus as one example of the invention in connection to a refrigerator; and FIG. 2 is an explanatory view of the inventive disposal apparatus in connection to the refrigeration cycle of the refrigerator shown in FIG. 1.

In FIGS. 1 and 2, 1 represents a refrigerator mounted with compressor 2; condenser 3, capillary tube 4 and evaporator 5 are sequentially connected to the compressor 2 and form a refrigeration cycle; the inventive disposal apparatus 6 of combustible fluorine-series refrigerant composition is connected to the compressor 1.

The inventive disposal apparatus 6 comprises combustion furnace 7, refrigerant feed unit 8 drawing out a combustible fluorine-series refrigerant composition from the compressor 2 in the refrigeration cycle of the refrigerator 1 and then feeding the composition into the combustion furnace 7 air feed unit 9 feeding fresh air for combustion into the combustion furnace 7, and water vapor feed unit 10 feeding water vapor to the combustion furnace 7.

The refrigerant feed unit 8 comprises pressure meter 11, pressure regulator 12, combustion nozzle 13 as a combustion means, and refrigerant conduit 14 connecting them together. One end of the refrigerant conduit 14 is connected to the tip of sealing pipe 15 for sealing the inventive combustible fluorine-series refrigerant composition to the compressor 2 in the refrigeration cycle.

The air feed unit 9 comprises filter 16, fan 17, and air passage 18.

The water vapor feed unit 10 comprises water tank 19, pump 20, and water conduit 21. One end of the water conduit 21 is connected to the water tank 19; and the other end thereof is connected to the combustion nozzle 13. Feeding just a required volume of water in the water tank 19 from the pump 20 through the water conduit 21 to the combustion nozzle 13, where water is evaporated into water vapor and is then mixed homogeneously with a combustible fluorine-series refrigerant composition fed through the refrigerant conduit 14 of the refrigerant feed unit 8, water is thus used for the combustion of the refrigerant composition.

Another example of the water vapor feed unit 10 includes commercially available vaporizers. When a vaporizer is used as the water vapor feed unit 10, water vapor can directly be fed to the combustion nozzle 13 or the combustion furnace 7.

The inventive disposal apparatus 6 is equipped with wheels 22 and handle 23, for convenience for handling.

When a combustible fluorine-series refrigerant composition in the refrigeration cycle of the refrigerator 1 is intended to be decomposed by combustion because of no use of the refrigerator, the inventive disposal apparatus 6 thus constructed is connected as shown in FIGS. 1 and 2. By feeding the combustible fluorine-series refrigerant composition through the refrigerant conduit 14 to the combustion nozzle 13 while regulating the pressure of the combustible fluorine-series refrigerant composition to a pressure suitable for combustion with the pressure regulator 12, the combustible fluorine-series refrigerant composition fed is mixed with water vapor prepared by allowing water fed through the water conduit 21 to combustion nozzle 13 to evaporate and be then blown out into the combustion furnace 7, where the composition is fired and combusted. Fan 17 in the air feed unit 9 feeds fresh air for combustion through filter 16 to the inside of the combustion furnace 7, as depicted by white arrow. The combustible fluorine-series refrigerant composition is continuously combusted and decomposed in a stable manner in the combustion furnace 7, while discharge gas is discharged through discharge pipe 24 to the outside, as shown by white arrow. 32 represents power cable for passing an electric current through heater 33 arranged in the combustion furnace 7; and 34 represents controller.

The inside o the furnace reaches a temperature of about 800° C. or more when a combustible fluorine-series refrigerant composition. is combusted and decomposed in the presence of water vapor in the combustion furnace 7 for disposal, so the combustion furnace 7 is required to have thermal resistance durable at the temperature. At the start of the operation, additionally, the combustion furnace 7 is heated and retained above 800° C., while an electric current is passed through the heater 33; after combustion initiates, the inside of the furnace is retained at a temperature above about 800° C. due to the combustion energy alone; by automatically switching off the. heater 33 via thermostat operation (not shown in the figures) and the like, then, the operation of the disposal apparatus 6 is controlled on the basis of the signal from the controller 34.

Figure 3:
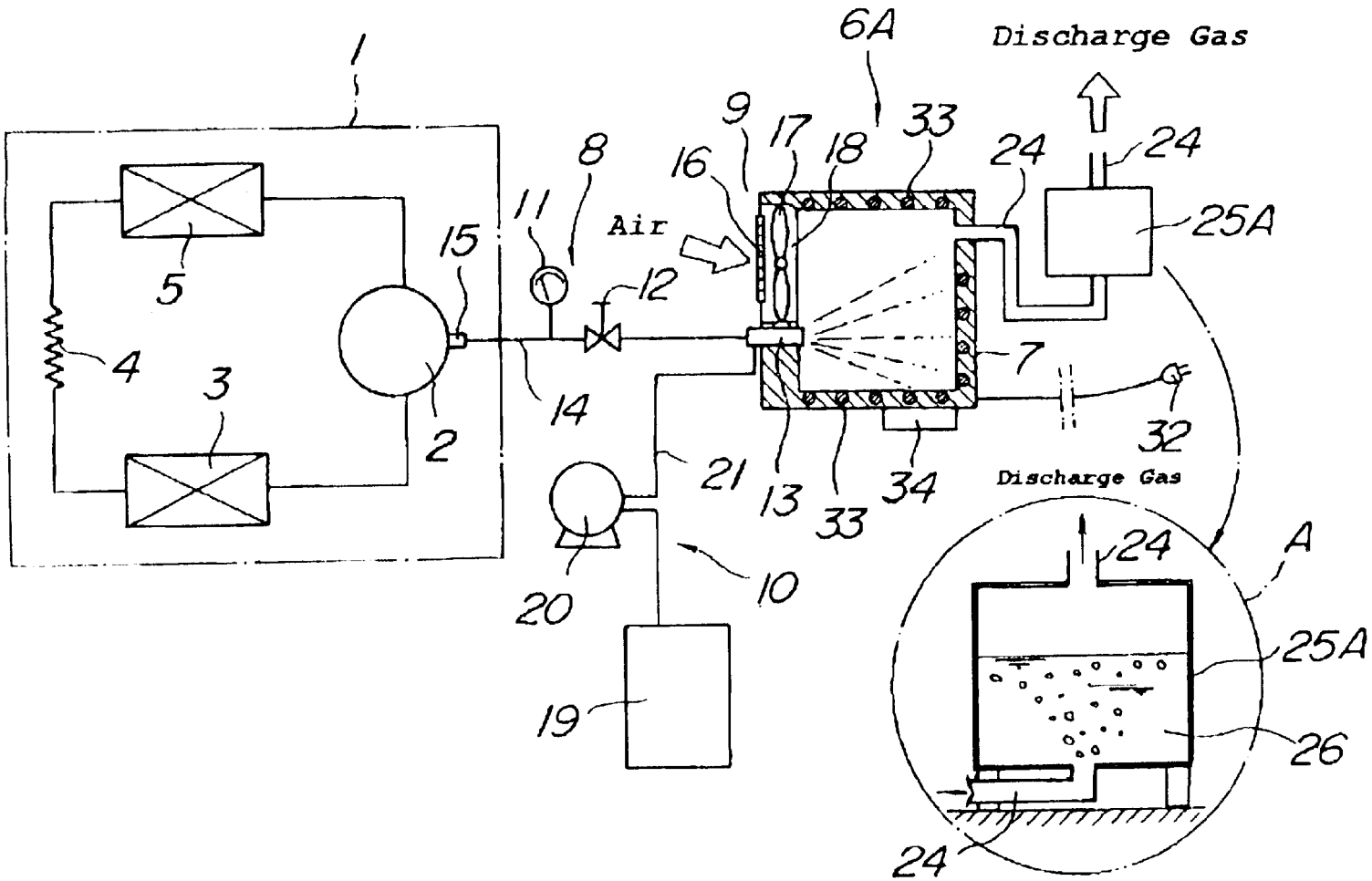
FIG. 3 is an explanatory view of another disposal apparatus of the invention in connection to the refrigerant cycle of the refrigerator shown in FIG. 1.

FIG. 3 is an explanatory view of another disposal apparatus of the invention in connection to the refrigeration cycle of the refrigerator shown in FIG. 1.

The inventive another disposal apparatus 6A comprises discharge gas disposal unit 25A in the midst of the discharge pipe 24. An enlarged explanatory view of the discharge gas disposal unit 25A is depicted in circle A.

As shown by the formula 2, a fluorine-series refrigerant combusted and decomposed involves generation of HCl and HF, which are discharged outside together with discharge gas. Before outward discharge, HCl and HF are absorbed from the discharge gas into alkaline materials such as calcium hydroxide and sodium hydrogencarbonate in the disposal apparatus 25A, whereby HCl and HF are neutralized and disposed.

By bubbling discharge gas containing HCl mist and HF mist from the discharge pipe 24 into aqueous sodium hydrogencarbonate solution 26, as depicted in the figure, HCl and HF are absorbed, neutralized and removed, as shown by the following formulas 3 and 4 The resulting discharge gas to be discharged outside from the discharge pipe 24 does not any more contain HCl or HF.

$$NaHCO_3+HCl \rightarrow NaCl+H_2CO_3 \quad (3)$$

$$NaHCO_3+HF \rightarrow NaF+H_2CO_3 \quad (4)$$

When discharge gas containing HCl mist and HF mist is bubbled from the discharge pipe 24 into aqueous calcium hydroxide solution 26, HCl and HF are absorbed and neutralized and thereafter removed, as shown by the following formulas 5 and 6. The resulting discharge gas to be discharged outside from the discharge pipe 24 does not any more contain HCl or HF.

$$Ca(OH)_2+2HCl \rightarrow CaCl_2\downarrow+2H_2O \quad (5)$$

$$Ca(OH)_2+2HF \rightarrow CaF_2\downarrow+2H_2O \quad (6)$$

According to the method using sodium hydrogencarbonate, the disposal of the liquid waste is problematic. Therefore, the method using calcium hydroxide is more practical and preferable, because precipitated $CaCl_2$ ard $CaF_2$ can be disposed together with the liquid waste. 120 g (1 mol) of R-12 generates 2 moles of HCl and 2 moles of HF, for which only 2 moles (152.2 g) of $Ca(OH)_2$ are needed as shown by the formulas 5 and 6. $Ca(OH)_2$ of 2 moles (152.2 g) packed in a cartridge or a bag is convenient for use.

Figure 4:
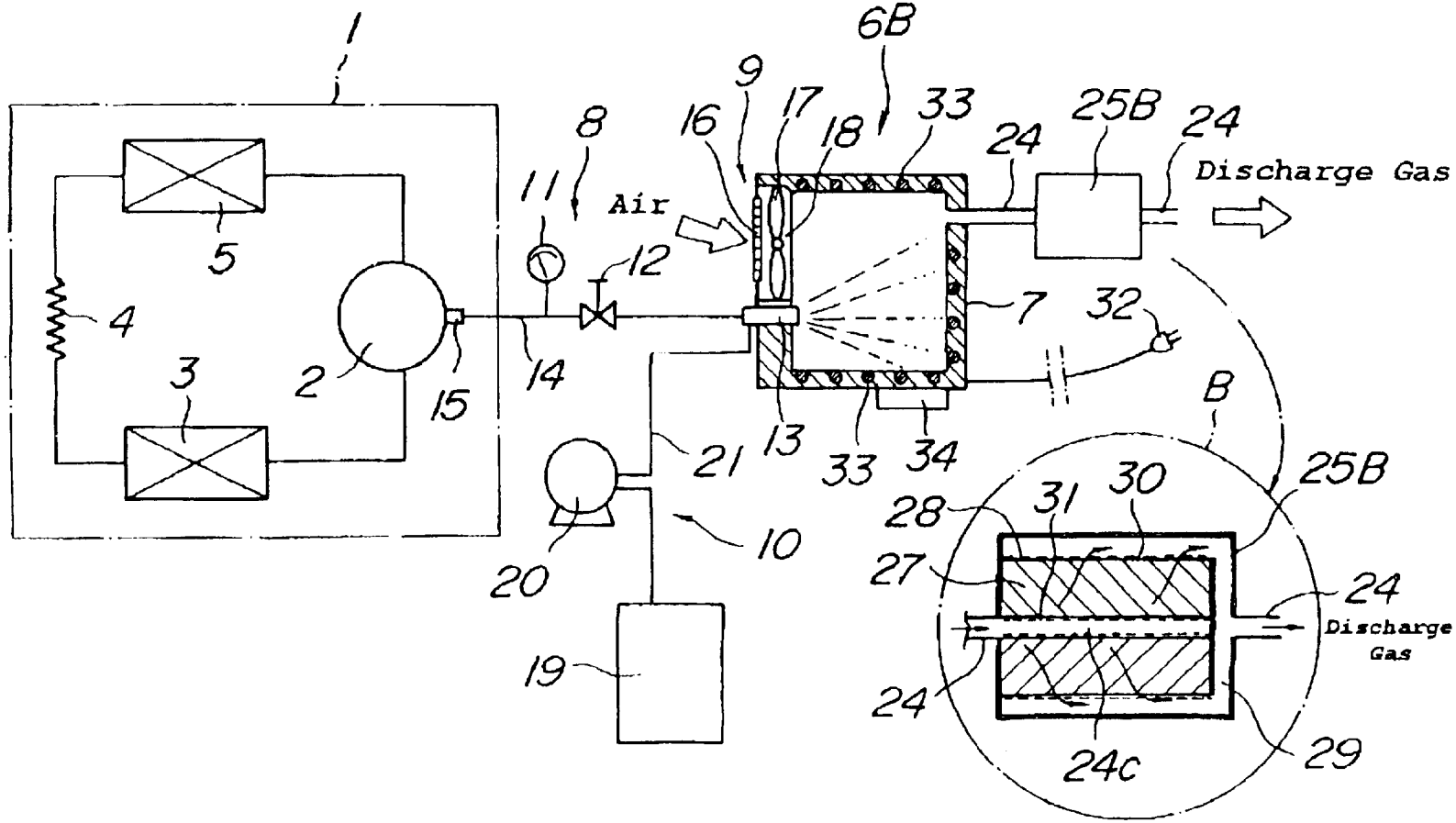
FIG. 4 is an explanatory view of an additional disposal apparatus of the invention in connection to the refrigerant cycle of the refrigerator shown in FIG. 1.

FIG. 4 is an explanatory view of an additional disposal apparatus of the invention in connection to the refrigeration cycle of the refrigerator shown in FIG. 1.

Another disposal apparatus 6B of the invention is equipped with discharge gas disposal unit 25B in the midst of the discharge pipe 24. An enlarged explanatory view of the discharge gas disposal unit 25B is depicted in circle B.

In the discharge gas disposal unit 25B, as shown in FIG. 4, top plate-mounted bottomed cylinder container 28 packed with solid getter agent 27 to immobilize acidic gases such as HCl and HF through absorption and neutralization is inserted between the inner walls of the disposal apparatus 25B in such a fashion that discharge gas passage 29 can be formed. A large number of pores 30 are arranged on the wall area excluding the top plate and bottom of the cylinder container 28. The discharge pipe 24 is arranged along the core of the getter agent 27 and is further elongated to the bottom of the cylinder container 28; a great number of pores 31 are arranged on the discharge pipe portion 24C elongating through the getter agent 27 in such a manner that the pores can be pierced therethrough.

Discharge gas containing acidic gases such as HCl and HF enters from the discharge pipe 24 into the discharge pipe portion 24C, passing through the pores 31 arranged in the discharge pipe portion 24C, to contact to the getter agent 27 to allow HCl and HF to be absorbed or neutralized, thereby immobilized. Discharge gas, from which HCl and HF are immobilized on the getter agent 27 and thereby removed, enters through the pores 30 on the wall area of the cylinder container 28 into discharge gas passage 29. Subsequently, the gas again passes through the discharge pipe 24. Through the discharge pipe 24, the gas is discharged to. the outside. Specific examples of the getter agent 27 in solid include for example clustered and integrated particles of calcium hydroxide, calcium carbonate and hydrosodalite, where discharge gas can be kept in contact to the particles while the gas passes through the inside thereof.

The invention is not limited to the embodiments, but various modifications and variations are possible within the scope of the invention according to the claims.

Advantages of the Invention

By combusting a combustible fluorine-series refrigerant composition in the presence of water vapor in the combustion furnace of the inventive disposal apparatus, heat due to the oxidation is continuously generated once the combustion thereof starts; the heat from the combustion successively progresses the combustion, to readily decompose hardly decomposable fluorine-series refrigerant gases and to avoid atmosphere discharge of non-decomposed fluorine-series refrigerant gases together with discharge gas.

Because acidic gases such as HCl and HF are readily removed by the inventive disposal apparatus equipped with a discharge gas disposal unit, these acidic gases are absolutely never discharged into air.

When the refrigerant feed unit is equipped with a pressure regulator and a combustion means, the combustible fluorine-series refrigerant composition continuously discharged from the refrigeration cycle can be adjusted continuously to the state of a pressure suitable for continuous combustion thereof, whereby the combustible fluorine-series refrigerant composition can be readily combusted and decomposed with combustion means such as combustion nozzle.

A combustible fluorine-series refrigerant composition allowed to contain $C_1$–$C_5$ hydrocarbons at above 6% by weight or more to above 90% by weight or less on the basis of the whole composition can readily be combusted and decomposed safely. Additionally, refrigeration oils including mineral oils and synthetic oils such as alkylbenzene and HAB can be used. Therefore, the apparatus is at high COP.

The inventive apparatus equipped with wheels and a handle can be modified as portable. Then, the resulting apparatus can be readily moved and transferred to a designated site.

The combustible fluorine-series refrigerant composition can be readily decomposed stably, when the composition is combusted in the presence of water vapor at a temperature of 800° C. or more inside the furnace.

A combustible fluorine-series refrigerant composition comprising a combination of an inflammable HFC refrigerant and $C_1$–$C_5$ hydrocarbons, or a combination of an inflammable HFC refrigerant, a combustible HFC refrigerant and $C_1$–$C_5$ hydrocarbons, wherein the mixtures of these gases with fresh air are continuously combustible in an atmosphere at a temperature of 800° C. or higher but are never continuously combustible in atmosphere at ambient temperature, can be more readily decomposed continuously in a stable manner.

What is claimed is:

1. A disposal apparatus of combustible fluorine-series refrigerant composition for drawing out and disposing a combustible fluorine-series refrigerant composition consisting essentially of a fluorine-series refrigerant and hydrocarbons having 1 to 5 carbon atoms from a refrigeration apparatus charged therewith, the disposal apparatus comprising a combustion furnace, a refrigerant feed unit for drawing out a combustible fluorine-series refrigerant composition from the refrigeration cycle of a refrigeration apparatus and feeding the composition to the combustion furnace, an air feed unit for feeding fresh air for combustion to the combustion furnace, and a water vapor feed unit for feeding water vapor to the combustion furnace, wherein the combustible fluorine-series refrigerant composition is combusted and decomposed in the presence of water vapor in the combustion furnace to be then disposed, and the hydrocarbons having 1 to 5 carbon atoms are contained at about 6 percent by weight or more to about 90 percent by weight or less on the basis of the whole composition.

2. A disposal apparatus according to claim 1, additionally comprising a disposal unit of discharge gas generated during the combustion and decomposition of a combustible fluorine-series refrigerant composition in the presence of water vapor.

3. A disposal apparatus according to claim 1, wherein the refrigerant feed unit comprises a pressure regulator and a combustion means connected to the pressure regulator.

4. A disposal apparatus according to claim 1, wherein the disposal apparatus is portable.

5. A disposal apparatus according to claim 1, the mixtures of combustible fluorine-series refrigerant composition with fresh air are continuously combustible in an atmosphere at a temperature of 800° C. or higher.

* * * * *